US006325707B1

(12) United States Patent
Rambeau

(10) Patent No.: US 6,325,707 B1
(45) Date of Patent: Dec. 4, 2001

(54) BELT BORER

(76) Inventor: Brady Rambeau, 4320 Modoc Rd., #M, Santa Barbara, CA (US) 93110

( * ) Notice: Subject to any disclaimer, the term of this patent is extended or adjusted under 35 U.S.C. 154(b) by 0 days.

(21) Appl. No.: 09/537,899

(22) Filed: Mar. 28, 2000

Related U.S. Application Data

(63) Continuation-in-part of application No. 09/023,994, filed on May 12, 1998, now abandoned.

(51) Int. Cl.[7] ..... B24B 214/00

(52) U.S. Cl. ..... 451/296; 451/299; 451/411; 451/414

(58) Field of Search ..... 451/168, 296, 451/299, 411, 414, 59

(56) References Cited

U.S. PATENT DOCUMENTS

| | | | | |
|---|---|---|---|---|
| D. 262,541 | * | 1/1982 | Fontaine | 451/299 |
| 2,660,205 | * | 11/1953 | Yetter | 451/414 |
| 3,968,728 | * | 7/1976 | Goldfarb et al. | 451/411 |
| 4,114,665 | * | 9/1978 | Decker | 451/299 |
| 4,926,602 | * | 5/1990 | Crouch | 451/296 |
| 4,939,870 | * | 7/1990 | Wang | 451/296 |

FOREIGN PATENT DOCUMENTS

| | | | | |
|---|---|---|---|---|
| 11088 | * | 2/1900 | (GB) | 451/299 |

* cited by examiner

*Primary Examiner*—Eileen P. Morgan

(74) *Attorney, Agent, or Firm*—Michael G. Petit

(57) ABSTRACT

A machine for the versatile removal of material for shaping an object. The machine includes a platform that provides support for three substantially horizontal and parallel plates. The uppermost plate or "table top" is height-adjustable and provides a working surface. The table top has a plurality of guide pins projecting downwardly therefrom and a centrally located aperture. The adjustable table top is supported by at least one height adjustment means such as a scissor jack interposed between the adjustable table top and an underlying support plate. The support plate is rigidly attached to the platform and has an aperture therein which underlies the aperture in the table top. A motor having a drive shaft with a belt drive thereon is attached to a motor mounting plate disposed below, and adjustably attached to, the overlying support plate. A circular drive belt having a grinding outer surface engages the belt drive and extends upwardly through the aperture in the support plate to rotationally engage a versatile split-pulley assembly. The split pulley assembly is affixed to, and extends upwardly from the support plate to project through the aperture in the table top. The portion of the drive belt and split-pulley assembly extending upwardly through the aperture in the table top is varied by raising and lowering the table top by means of one or more scissor jack(s). The drive belt preferably has a grinding outer surface and includes a guide belt adhered to, and coextensive with the inner surface of the drive belt. The guide belt maintains the position of the drive belt on the split-pulley assembly. A variety of cutting accessories are disclosed which may be attached to the split-pulley assembly. The machine includes several different types of belt drives, belts and split-pulleys, each suited for performing a specific grinding or cutting operation.

4 Claims, 5 Drawing Sheets

BELT BORER

This is a continuation-in-part of application Ser. No. 09/023,994; filed May 12, 1998 now abandoned

BACKGROUND OF THE INVENTION

1. Field of the Invention

This invention relates to plastics and woodworking machinery and, more particularly, to a machine for shaping a material by means of cutting or grinding.

2. The Prior Art

In accordance with the prior art, several types of machines are used consecutively to shape a material such as wood or plastic. Various cutting tools such as table saws, routers, miter saws, mortise machines, belt sanders, disk sanders, barrel sanders, chain saws, planers, jointers, drills and mills are used to form a material into a desired form. Acquiring and installing all these machines necessary for performing the required steps in the shaping process is expensive and space consuming. The machine disclosed in the present invention is designed to solve this problem. Patents illustrative of some of these prior art machines include U.S. Pat. Nos. 5,121,554; 4,787,127; 4,445,811; D325,862; 4,456,042; 4,939,870; 5,890,521 and 4,964,241.

SUMMARY OF INVENTION

It is a primary objective of the invention to provide a machine operable for removing material from an object to provide a desired shape. The present invention provides a multi-purpose, belt-driven machine that can, in conjunction with accessories, perform the functions of a table saw, router, planer, jointer, belt sander, disk sander, mortise, grinder and a borer. The outer surface of the drive belt includes an abrasive material adhered thereto. In addition to transferring mechanical energy from a motor to the work surface, the abrasive surface of the drive belt is operable for cutting a material to be shaped.

It is a further object of the invention to provide a drive belt having an abrasive outer surface and an inner opposing surface adapted to transfer rotational energy from a motor shaft to a rotatable member adapted to receive and support a cutting tool.

It is yet a further object of the invention to provide a machine having a working surface adapted to support a material object to be shaped and means for positioning and repositioning the object in cutting relationship with a cutting tool.

The machine may be used with both regular and modified belted sandpaper, disked sandpaper, router bits, circular saw blades, grinding wheels and chain saw bar and chains to remove material to shape an object. The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DETAILED DESCRIPTION OF DRAWINGS AND PREFERRED EMBODIMENT

Figure 1:
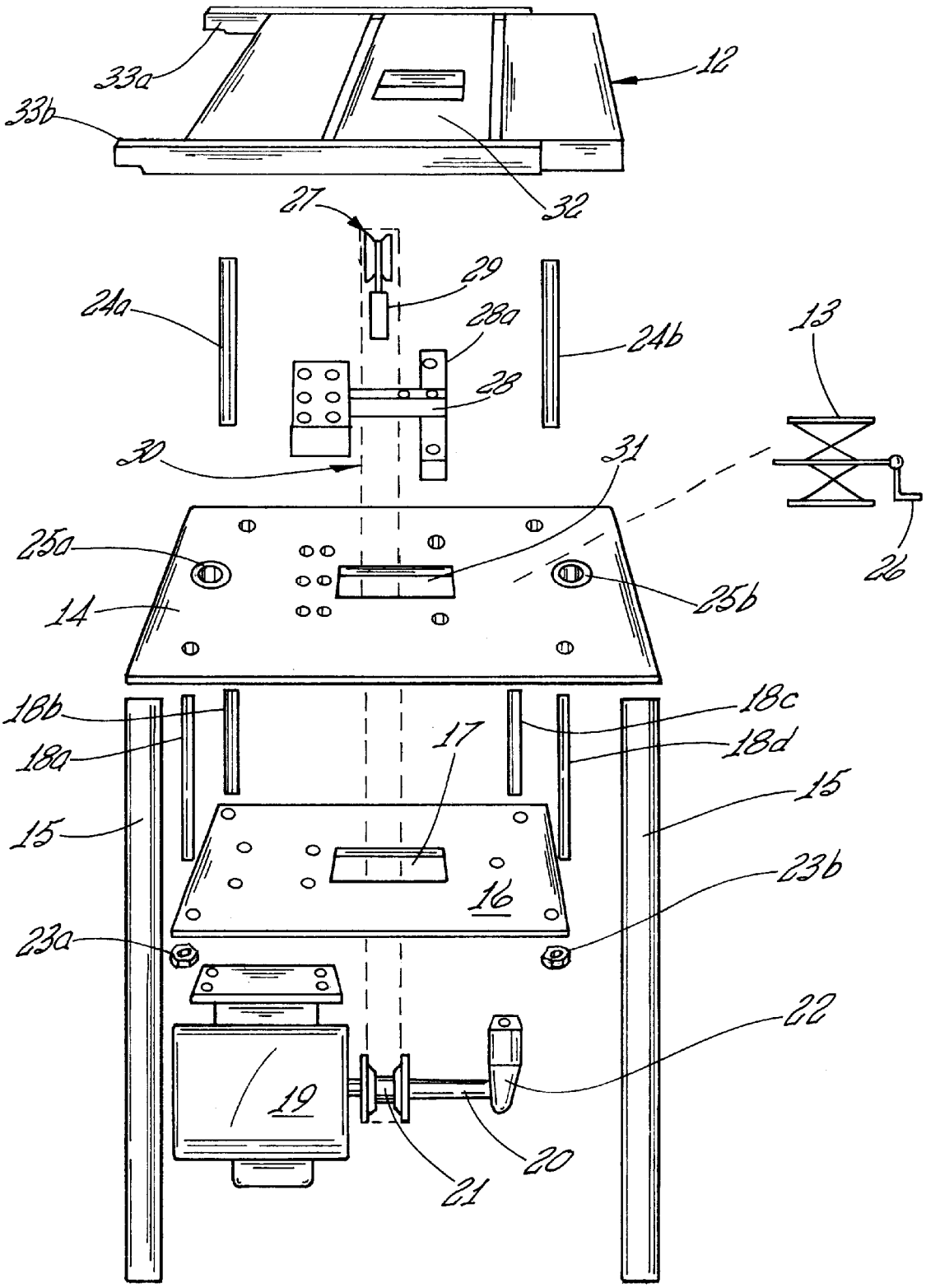
FIG. 1 is a front exploded perspective view of a boring machine in accordance with the present invention. with the drive belt indicated in phantom.

With reference now to FIG. 1, there is shown a cutting and grinding machine 10 in accordance with the present invention, which includes adjustable table top 12. A scissors jack 13 is disposed between the table top 12 and a table top support plate 14. The support plate 14 is rigidly attached to platform legs 15. A motor mounting plate 16 having a rectangular aperture 17 therein is adjustably attached to the support plate 14 by means of four threaded studs 18*a–d*. A motor 19 having a drive shaft 20 with a belt drive 21 attached thereto is attached to the lower surface of the motor mounting plate 16 by means of threaded bolts (not shown). The end of the drive shaft 20 is supported by a pillow block 22 which is attached to the motor mounting plate 16 by means of threaded bolts (not shown). The spacing between the motor mounting plate 16 and the table top support plate 14 is adjustable by means of threaded nuts 23*a–d* rotatably mounted on, and in threaded engagement with, the threaded studs 18*a–d*.

Focusing attention now on the components of the machine 10 that are attached to the upper surface of the support plate 14, the table top 12 has guide pins 24*a* and 24*b* rigidly attached to the lower surface thereof which extend downwardly through guide bushings 25*a* and 25*b* in the support plate 14. The spacing between the lower surface of the table top 12 and the support plate 14 is adjusted by rotating the handle 26 on the scissor jack 13. A split pulley 27 is attached to a pulley-mounting bracket 28 affixed to the support plate 14 by means of an inner pulley support 29. Thus, the length of the inner pulley support 29 fixes the height of the split pulley relative to the support plate. A circular drive belt 30 (shown in phantom in FIG. 1) provides rotational engagement between the belt drive 21 on the motor drive shaft 20 and the split pulley 27, passing through aperture 17 in the motor mounting plate and an aperture 31 in the support plate. The table top 12 includes a rectangular aperture 32 dimensioned to accommodate the split pulley therewithin such that when the table top 12 is lowered by height adjustment means such as the scissor jack 13, the split pulley 27 projects above the upper surface of the table top 12, presenting a cutting tool. The table top 12 includes guide rails 33*a* and 33*b* operable for maintaining alignment between the cutting tool comprised of the split pulley and drive belt and an object to be shaped (not shown in FIG. 1) disposed on the upper surface of the table top 12.

Figure 2:
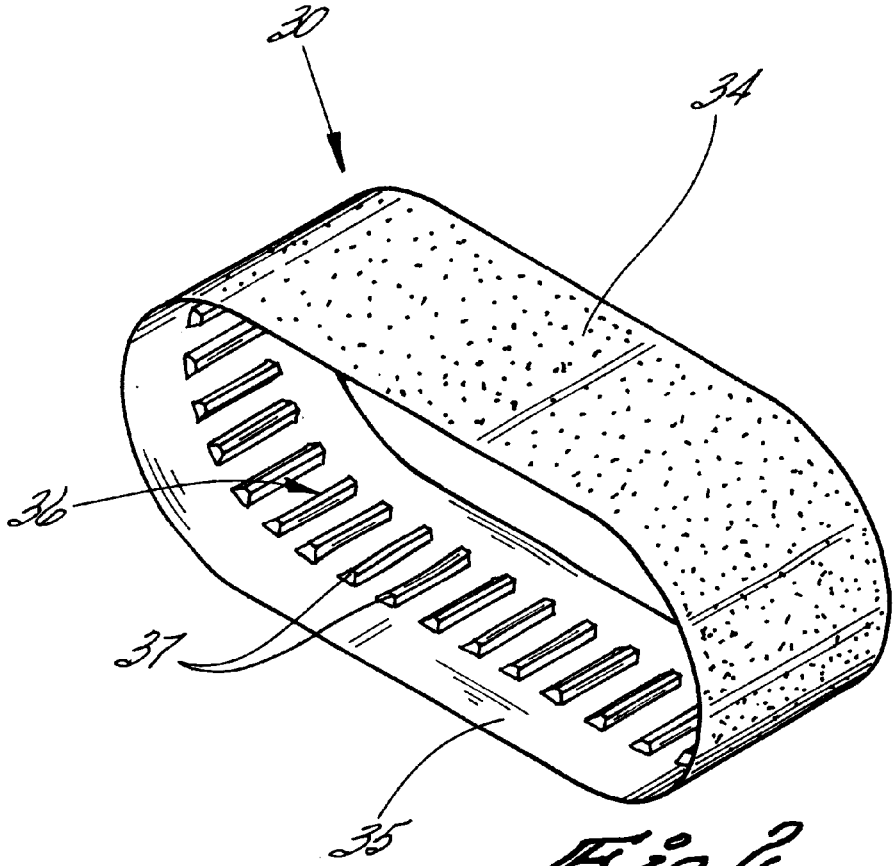
FIG. 2 is a perspective view of a drive belt having a guide belt on the inner surface thereof in accordance with a preferred embodiment of the present invention.
Figure 3A:
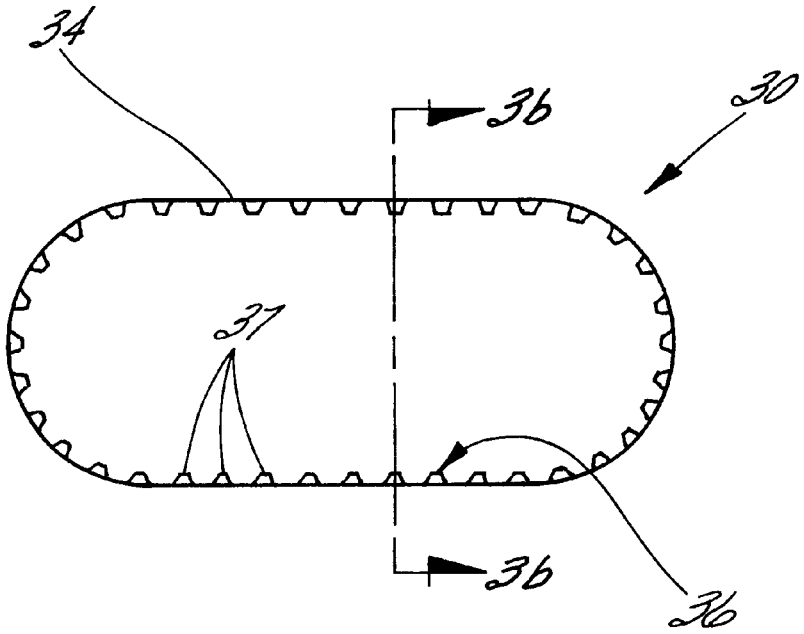
FIG. 3*a* is a side view of a drive belt having a guide belt on the inner surface thereof in accordance with the preferred embodiment of the present invention illustrated in FIG. 2.
Figure 3B:
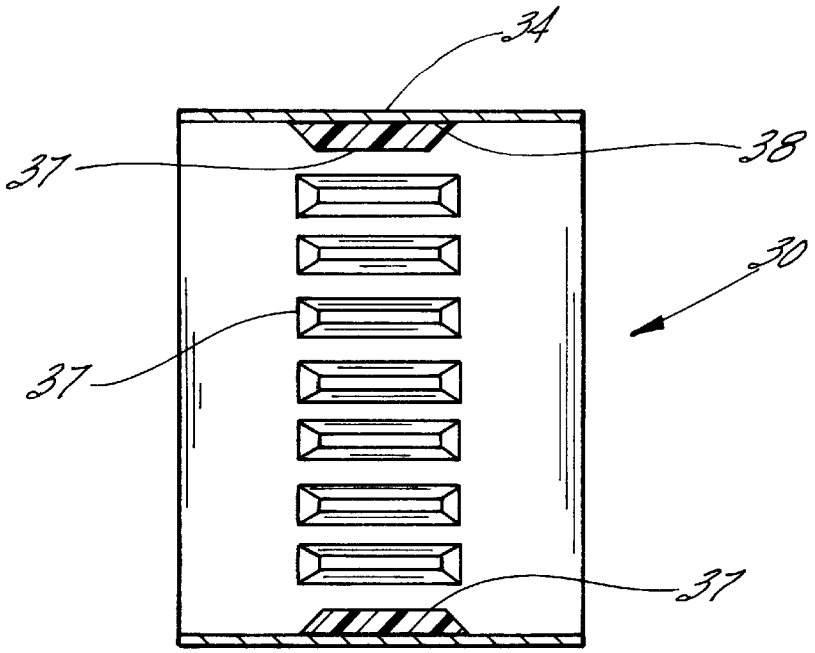
FIG. 3*b* is a cross-sectional view of a drive belt taken along section line 3*b*—3*b* of FIG. 3*a*.

Turning now to FIG. 2, there is shown, in perspective view, a drive belt 30 in accordance with a preferred embodiment of the invention. The drive belt 30 is circular and includes an abrasive outer surface 34 and an inner surface 35. The inner surface 35 is preferably cloth and has a guiding belt 36 adhered thereto, which is coextensive with the inner surface of the drive belt. The width of the guide belt 36 is uniform along the length thereof and less than the width of the drive belt 30 and includes a plurality of cleats 37 spaced from one another to matingly engage cogs on the belt drive. FIG. 3 is a side view of the drive belt 30 illustrating the relationship between the drive belt 30 and the guide belt 36 affixed to the inner surface thereof. The skilled artisan will appreciate that while the cleats 37 are shown (in FIGS. 2 and 3*a*) as being affixed to a guide belt 36 which, in turn, is adhered to the inner surface of the drive belt 30, it is understood that the cleats 37 may be affixed directly to the inner surface of the drive belt by adhesive means 38 (FIG. 3*b*) without departing from the scope of the present invention.

Figure 4:
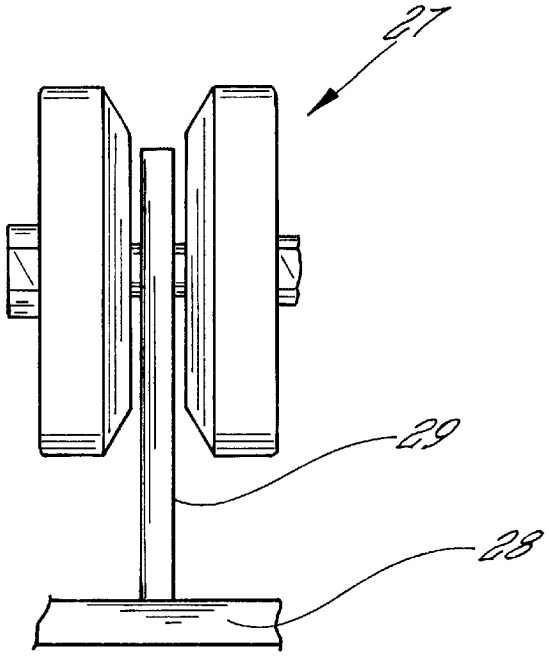
FIG. 4 is a front elevational view of a split-pulley assembly in accordance with the present invention.
Figure 5:
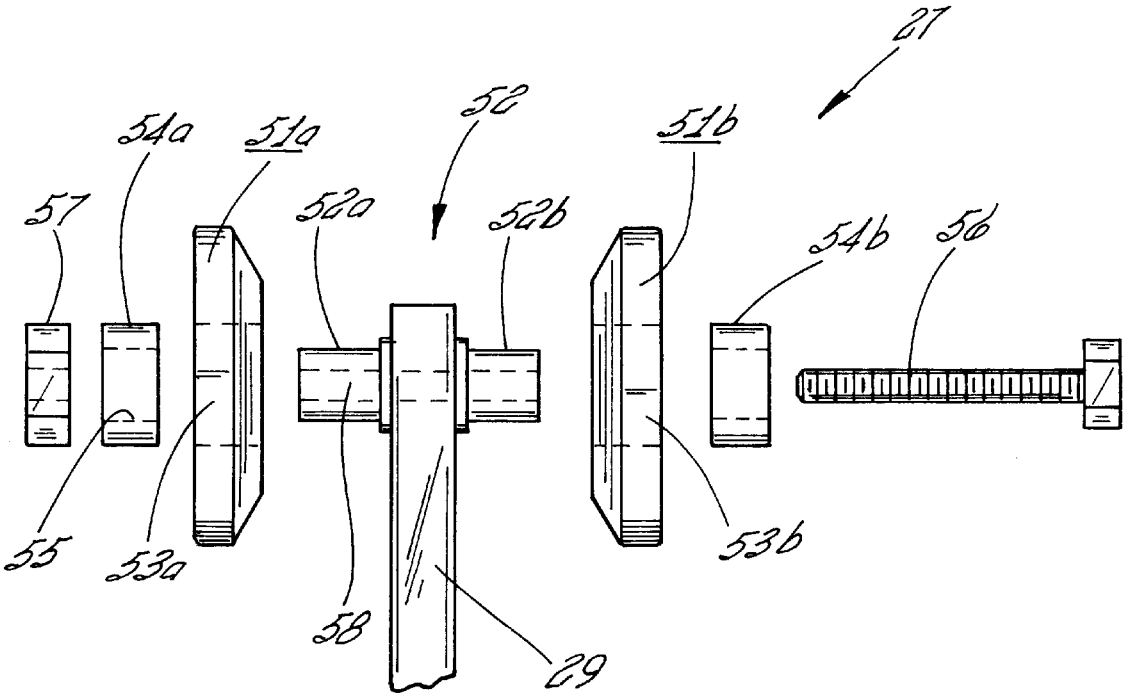
FIG. 5 is an exploded front view of a split-pulley assembly in accordance with the present invention.

With reference to FIGS. 4 and 5, the split pulley assembly 27 is rotatably mounted on the inner-pulley support 29, which, in turn, is attached to the top of the t-shaped support bar 28. FIG. 5 is an exploded view of a preferred embodiment of the split pulley assembly 27 in accordance with the present invention. The pulley halves 51*a* and 51*b* are attached to a pair of inner-pulley support pins 52*a* and 52*b* projecting laterally from the inner pulley support 29. The pulley halves 51*a* and 51*b* have cylindrical axial bores 53*a* and 53*b* into which bearings 54*a* and 54*b* respectively are pressed. The inner bearing surfaces 55 of the respective bearings are dimensioned to fit snugly over the inner pulley support pins 52*a* and 52*b*. The split pulley assembly is held together by means of a bolt 56 and a nut 57. An axial bore 58 coextensive with the support pins 52*a* and 52*b* is provided to accommodate the passage of the bolt 56 therethrough.

The machine comprises a platform supporting an adjustable height table top. The table top has adjustable guide grooves and rails on the upper (working) surface thereof and a substantially rectangular aperture (hole) near the middle thereof. The table top further includes a plurality of guide pins affixed thereto and extending downwardly therefrom. The platform includes a table top support plate, which underlies and is adjacent to the table top. The table top Support plate has a central aperture which underlies the aperture in the table top and a plurality of bushings perforating the support plate through which the plurality of guide pins slidingly extend. The plurality of bushings are preferably disposed symmetrically with respect to the aperture on the support plate. The machine includes height adjustment means disposed between the support plate and the table top operable for varying the spacing therebetween. The guide pins serve to maintain alignment between the apertures in the table top and the support plate while the spacing is varied by the height adjustment means. A preferred height adjustment means is a scissor jack but pneumatic and hydraulic jacks may also be used. The base of the scissor jack is affixed to the upper surface of the support plate with the weight bearing upper surface of the scissor jack affixed to the lower surface of the table top.

The platform further includes a motor mounting plate, which underlies the support plate and is attached thereto by four threaded rods. The threaded rods have nuts and washers thereon that are used to raise or lower the motor mounting plate. If the motor is disposed beneath the motor mounting plate, as shown in FIG. 1, the motor mounting plate further includes a rectangular aperture vertically aligned with the apertures in the table top and support plate. The motor has a drive shaft supported by a pillow block, the drive shaft having a belt drive pulley disposed thereon between the motor and the pillow block. The pillow block is attached to the overlying motor mounting plate and provides support for the drive shaft.

The belt drive pulley powers a circular loop drive belt that has a cleated inner surface, the cleats being uniformly spaced and dimensioned to snugly fit within a tapered groove in the drive pulley. The other end of the circular loop drive belt is supported by, and drives a pulley assembly that is Supported by an inner-pulley support. The inner-pulley support is mounted on a t-shaped support bar. The t-shaped support bar is mounted on the support plate and has a portion that projects into the rectangular aperture in the support plate. The t-shaped support bar is open on one end to allow a belt to be installed. After a belt is installed, a connecting bracket (shown at 28*a* in FIG. 1) is installed between the t-shaped support bar and the support plate to support the open end of the t-shaped support bar. An inner-pulley support mounted on the portion of the t-shaped support bar includes a pair of symmetrically disposed cylindrical support pins over which the bearings in the pulley halves are mounted. The inner-pulley support pins have an axial bore therein which accommodates a bolt therein, which attaches the pulley halves to the pulley support.

Different types of belt drives, belts, chains, pulley halves, chain bars and inner-pulley supports may be readily adapted for use with the machine. The choice of such parts will depend upon the specific grinding or cutting operation that the machine is going to perform. Cogged v-belts, traction belts, flat belts and different types and sizes of belted sandpaper can be used with the present machine. The machine preferably uses belted sandpaper that has a guiding belt glued onto its cloth side but can also be used with regular belted sandpaper without a guiding belt. The guiding belt keeps the belted sandpaper from rolling off of the inner-supported pulley assembly by fitting snugly within the grooves of the belt drive and the split pulley assembly. Because the split pulley assembly has no external supports, it can penetrate the material object from which it is removing material to accomplish the shaping process.

Figure 6:
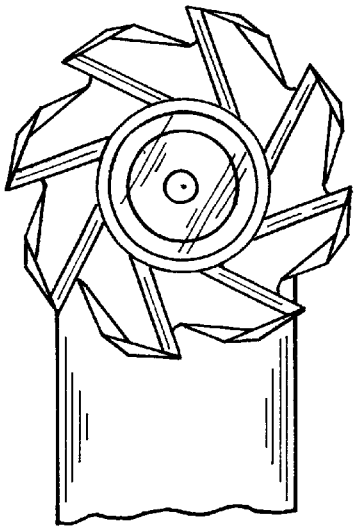
FIG. 6 is a side view of a pulley half that has cutting teeth.
Figure 7:
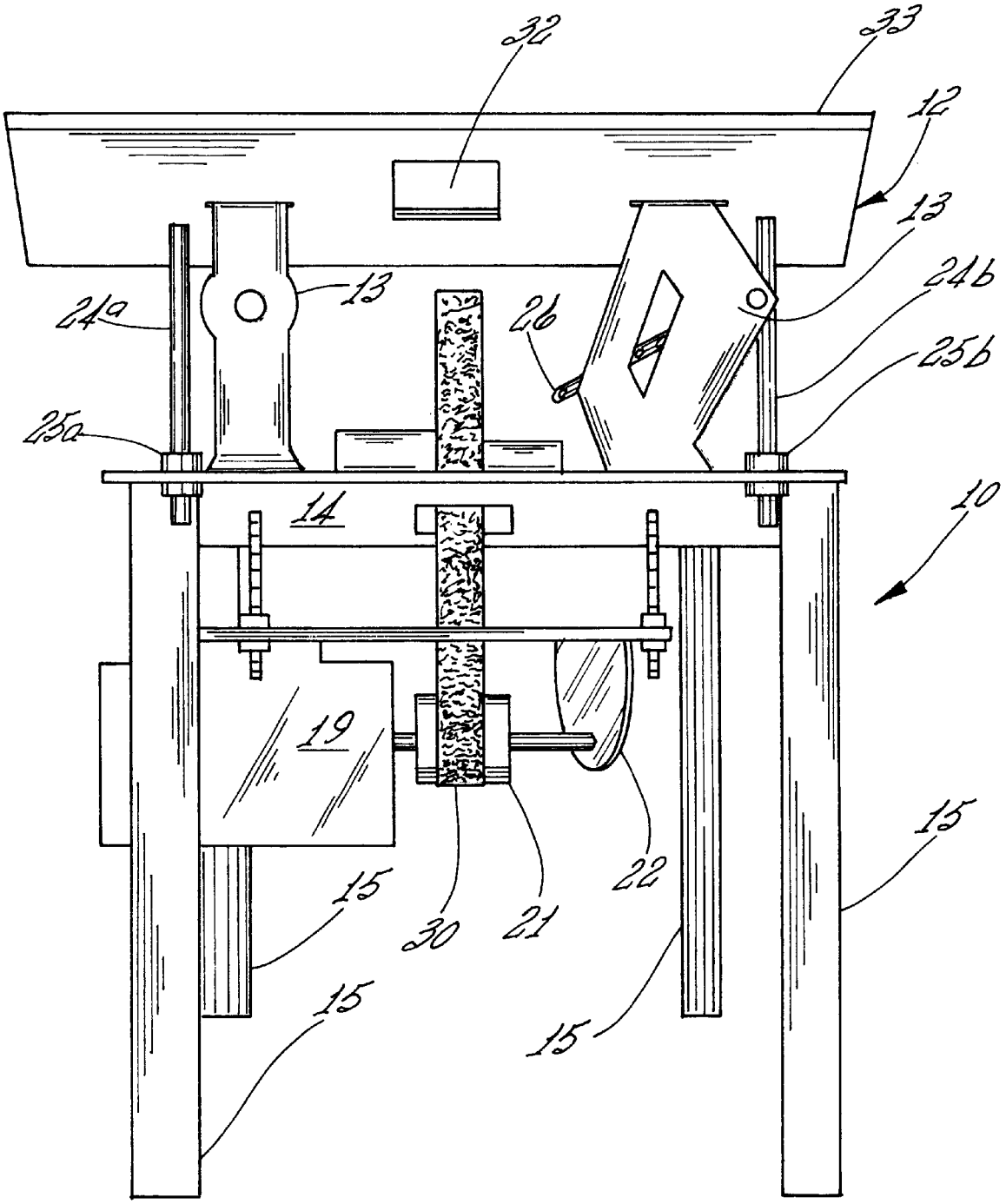
FIG. 7 is a rear perspective view of an assembled belt boring machine in accordance with a preferred embodiment of the present invention.

The types of pulley drives which may be used on the present machine are pulleys operable for driving v-belts, flat belts, traction belts, power transmission belts and belted sandpaper with or without a guide belt. The types of chains which may be used on the present machine includes chain saw chains and drive chains. The types of gear drives used by this machine are drive gears for drive chain and drive gears for chain saw chain. The types of chain bar used on this machine are designed to be supported upon the t-shaped support bar in place of the inner-pulley support. The types of pulley halves, which may be used with the present machine, include pulley halves that are adapted for use as cutting tools, as shown, for example, in FIG. 6.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A machine for removing material from a selected portion of a material object comprising:

(a) a table top comprising a flat horizontal plate having a first aperture therein, an upper surface and a lower surface;

(b) a plurality of guide pins affixed to said lower surface of said table top and projecting vertically downward therefrom;

(c) a flat horizontal support plate disposed to underlie said table top and having an upper surface and a second aperture therein;

(d) adjustable extendable means disposed between said lower surface of said table top and said upper surface of said support plate, said adjustable extendable means being operable for supporting said table top and for changing the distance between said support plate and said table top;

(e) a motor adjustably mounted on a motor mounting plate disposed below said support plate, said motor having a drive shaft and a belt drive attached to said drive shaft;

(f) a split pulley assembly mounted on said support plate and disposed between said first and second apertures; and (g) a circular loop belt having an abrasive outer surface connecting said belt drive and said split pulley assembly;

wherein when said motor is energized and the material object is placed on said upper surface of said table top such that a selected portion of the material object overlies said first aperture and said table top lowered toward said support plate by adjusting said extendable means, a portion of said split pulley assembly and said circular loop belt projects upwardly through said first aperture and said outer abrasive surface on said circular loop belt removes material from a selected portion of the material object.

2. The machine of claim 1 wherein said support plate has a plurality of bushings therein, said plurality of bushings being in vertical alignment with said plurality of guide pins and wherein said plurality of guide pins slidably engage said plurality of bushings thereby maintaining vertical alignment between said first and second apertures when said extendable means is adjusted.

3. The machine of claim 1 wherein said circular loop belt has an inner surface in opposition to said outer surface and wherein said inner surface comprises a plurality of evenly spaced cleats affixed thereto, said plurality of cleats being operable for frictional engagement with said belt drive and said split pulley assembly.

4. The machine of claim 1 wherein said split pulley assembly comprises two pulley halves wherein at least one of said two pulley halves is a cutting tool.

* * * * *